US006550216B1

(12) United States Patent
Ohanesian

(10) Patent No.: US 6,550,216 B1
(45) Date of Patent: Apr. 22, 2003

(54) STORAGE SHED

(76) Inventor: Harout Ohanesian, 9 Tattersail La., Laguna Niguel, CA (US) 92677

( * ) Notice: Subject to any disclaimer, the term of this patent is extended or adjusted under 35 U.S.C. 154(b) by 0 days.

(21) Appl. No.: 09/557,045

(22) Filed: Apr. 21, 2000

(51) Int. Cl.[7] ..... E04C 2/54

(52) U.S. Cl. ..... 52/783.11; 52/783.19; 52/537; 52/79.1; 52/731.7

(58) Field of Search ..... 52/783.11, 783.19, 52/537, 79.1, 731.2, 731.4, 731.5, 731.7, 731.8, 731.9, 780, 781, 782.1, 782.2, 736.4, 737.4, 764

(56) References Cited

U.S. PATENT DOCUMENTS

| | | | | | |
|---|---|---|---|---|---|
| 370,659 | A | * | 9/1887 | Sagendorph | 52/731.2 |
| 2,013,763 | A | * | 9/1935 | Olsen | 52/780 |
| 2,956,705 | A | | 10/1960 | Clingman | |
| 3,661,434 | A | | 5/1972 | Alster | |
| 3,729,881 | A | | 5/1973 | Disko | |
| 3,736,035 | A | | 5/1973 | Brown et al. | |
| 3,741,593 | A | | 6/1973 | Toti | |
| 3,797,186 | A | * | 3/1974 | Smith | 52/314 |
| 3,836,218 | A | | 9/1974 | Hallal | |
| 3,847,460 | A | | 11/1974 | Weidt | |
| 3,975,877 | A | | 8/1976 | Walton | |
| 4,527,370 | A | | 7/1985 | Schuette | |
| 4,865,402 | A | | 9/1989 | Walter | |
| 4,910,928 | A | | 3/1990 | Cellar, Jr. | |
| 5,078,367 | A | | 1/1992 | Simpson et al. | |
| 5,237,790 | A | * | 8/1993 | Smalley | 52/92.1 |
| 5,293,725 | A | | 3/1994 | Matticks et al. | |
| 5,398,468 | A | | 3/1995 | Erickson | |
| 5,437,573 | A | | 8/1995 | Rodriguezferre | |
| 5,513,759 | A | | 5/1996 | Besserer et al. | |
| 5,549,372 | A | | 8/1996 | Lewis | |
| 5,634,300 | A | | 6/1997 | Huebner et al. | |
| 5,647,181 | A | | 7/1997 | Hunts | |
| 5,647,650 | A | | 7/1997 | Daugherty et al. | |
| 5,864,997 | A | * | 2/1999 | Kelly | 52/79.1 |
| 6,112,473 | A | * | 9/2000 | Pingel | 52/737.4 |

* cited by examiner

*Primary Examiner*—Jose V. Chen
*Assistant Examiner*—Chi Q. Nguyen
(74) *Attorney, Agent, or Firm*—Myers Dawes & Andras; Vic Y. Lin; Joseph C. Andras

(57) ABSTRACT

A storage shed comprises a plurality of posts erected onto a base. The posts comprise a prismatic profile disposed over a hollow bar to form a void and a longitudinal slot. Corrugated wall panels are disposed in between the posts. U-channels are coupled to the base to support the posts and wall panels. The wall panels include parallel latitudinal folds and longitudinal side flanges which fit into the longitudinal slots of the posts. A roof frame is disposed on top of the vertical posts and wall panels. Corrugated roof panels are disposed on the roof frame. The corrugated roof panels include parallel latitudinal folds and side portions adapted to overlap with each other. Ridge panels are disposed at the ridge of the roof frame so as to cover a portion of the roof panels on each side of the shed. Facia boards are disposed on an entrance end and a rear end of the roof frame. Doors are disposed on an entrance side of the shed. The vertical posts, wall panels, roof panels, doors, and facia boards can be made of polyvinyl chloride. An aesthetic layer may be applied to an exterior side of the wall panels and roof panels. A method for building a shed is also provided.

35 Claims, 11 Drawing Sheets

STORAGE SHED

BACKGROUND OF THE INVENTION

1. Field of the Invention

The invention relates generally to storage sheds.

2. Description of Related Art

A storage shed often provides a convenient way of storing various kinds of property and materials. Since they are typically located outdoors, it is important that storage sheds are sturdy enough to withstand all types of weather.

Prior art storage sheds are constructed out of conventional materials, such as timber and plywood. Not only are these materials expensive, they do not withstand harsh conditions well. Modular shed products using aluminum posts and wall panels tend to have a flimsy appearance.

Scrap polyvinyl chloride is created in any manufacturing facility that uses the material to produce other products. Though the scrap polyvinyl chloride may be reground or recycled, only a small percentage, if any, can be incorporated into new products due to structural and aesthetic reasons.

Therefore, a need remains for an inexpensive storage shed with a sturdy structure and composition that can withstand harsh environmental conditions.

SUMMARY OF THE INVENTION

In accordance with the present invention, both structures and methods are disclosed. Structures are provided not only for a storage shed as a whole, but also for certain modules forming the shed. A method is provided for building a shed.

The shed comprises posts, corrugated wall panels disposed in between the vertical posts, and corrugated roof panels. Each corrugated wall panel comprises a plurality of folds and at least one longitudinal side flange.

Each post comprises at least one longitudinal slot sized to receive one of the longitudinal flanges of the corrugated wall panels. Each post comprises a bar and a prismatic profile disposed around the bar. A longitudinal slot is defined in the profile and a void is defined between an external surface of the bar and an internal surface of the profile. The profile comprises a thermoplastic material, including polyvinyl chloride. A guide is disposed on the base for supporting the posts and corrugated wall panels. The guide comprises a U-channel disposed along a periphery of the base.

The corrugated wall panels comprise a thermoplastic material, which includes polyvinyl chloride. The corrugated wall panel may comprise an aesthetic layer disposed on an exterior side. The folds of the corrugated wall panels are latitudinal and parallel. Each corrugated wall panel may comprise an indented top flange and an indented bottom flange. The corrugated roof panels comprise flat side portions. The side portions of adjacent corrugated roof panels overlap. The shed further comprises doors and a roof frame having a plurality of tubes. The corrugated roof panels are disposed on the roof frame. The shed may further comprise a base wherein the posts are disposed along a periphery of the base.

In another aspect, a structure for a corrugated building panel is provided. The corrugated building panel comprises polyvinyl chloride, a plurality of parallel latitudinal folds, a longitudinal side flange, and an aesthetic layer. The aesthetic layer comprises a virgin polyvinyl chloride laminate that is thermoformed on an external side of the panel. The plurality of parallel latitudinal folds comprises ridges and channels extending horizontally. The longitudinal side flange extends from a bottom of the panel to a top of the panel. The panel further comprises an indented top flange, an indented bottom flange, and an outwardly protruding border surrounding the plurality of parallel latitudinal folds. The corrugated building panel may serve as a wall panel for a shed with posts wherein the longitudinal side flange is sized to fit into a corresponding longitudinal slot of a post. The corrugated building panel may also serve as a roof panel for a shed wherein the longitudinal side flange is shaped to overlap with a longitudinal side flange of an adjacent roof panel.

In another aspect, a structure for a building post is provided. The building post comprises a prismatic profile having a longitudinal slot defined therein. The longitudinal slot is adapted to receive a wall panel. The post may further comprise a bar disposed within the profile. The profile is shaped around the bar so as to form a void between an external surface of the bar and an internal surface of the profile. The profile comprises a thermoplastic material, including polyvinyl chloride. The post comprises metal, wood, plastic or any other rigid material. The post may be hollow. The longitudinal slot extends inwardly towards the bar such that the internal surface of the profile contacts the external surface of the bar.

A method for building a shed is also provided. The method comprises: providing a base; erecting posts with longitudinal slots onto the base; disposing between the posts corrugated wall panels with longitudinal side flanges; fitting the longitudinal side flanges of the corrugated wall panels into the longitudinal slots of adjacent posts; mounting a roof frame above the vertical posts and the corrugated wall panels; and disposing corrugated roof panels on the roof frame. Disposing corrugated roof panels on the roof frame further comprises overlapping side portions of adjacent corrugated roof panels.

The method further comprises the following, each of which may be performed separately from or in combination with the others: disposing a door along an entrance side of the shed; making the corrugated wall panels and the corrugated roof panels out of recycled polyvinyl chloride; disposing an aesthetic laminate layer on an external side of the corrugated roof panel; disposing an aesthetic laminate layer on an external side of the corrugated wall panel; and, disposing a U-shaped channel along a perimeter of the base for supporting the posts and corrugated wall panels.

Figure 1:
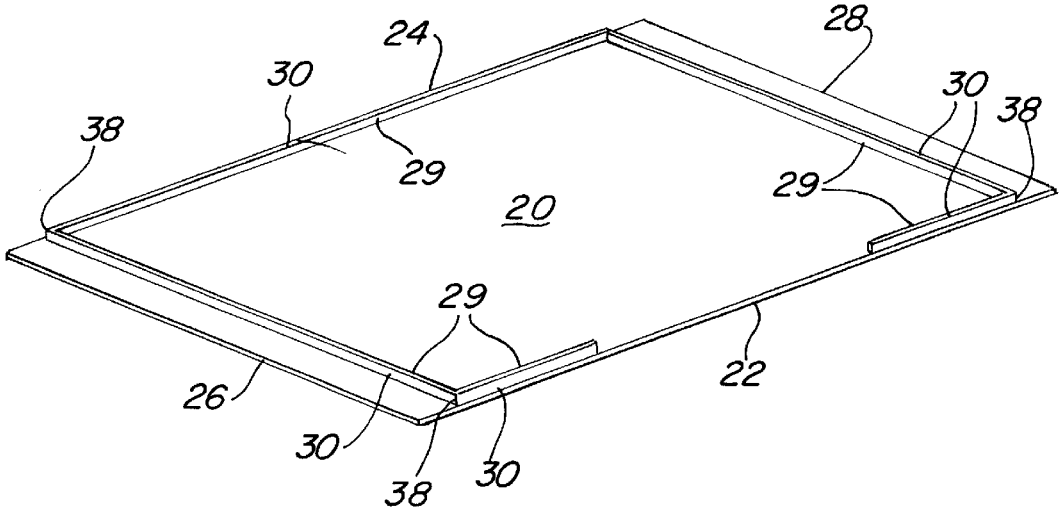
FIG. 1 is a perspective view of a base of a storage shed.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS

A storage shed according to the present invention is shown in the figures and designated generally by the reference numeral 10.

Figure 5C:
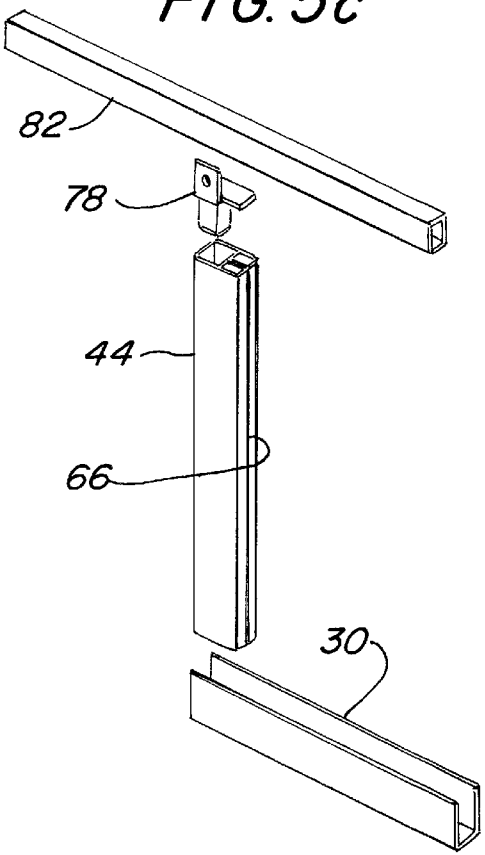
FIG. 5*c* is an exploded view of a door post assembly.
Figure 5B:
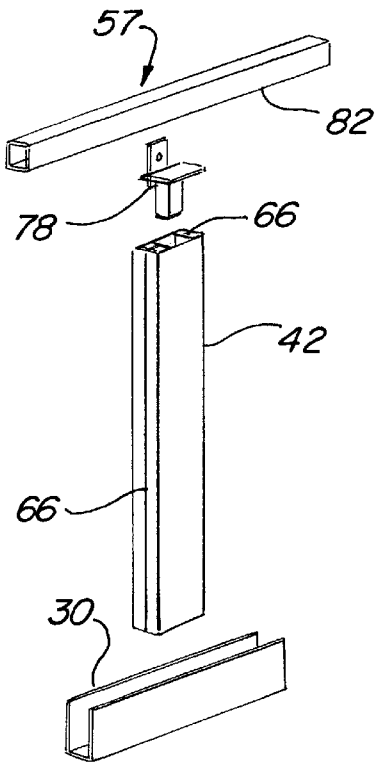
FIG. 5*b* is an exploded view of a middle post assembly.

FIG. 1 is a perspective view of a base 20 of the storage shed. Though the base is included in the preferred embodiment, it is to be expressly understood that the base is not essential and that the shed may be built directly upon the ground. The storage shed has an entrance side 22, a back side 24, a left side 26 and a right side 28. In the preferred embodiment, the base 20 is rectangular and made of multiple panels of plywood which are coupled together, although any material may be used. Guides 30 are disposed adjacent to the front side 22, the left side 26, the right side 28, and the back side 24. In the preferred embodiment, the guides 30 comprise U-channels 30 although a variety of other structures may be used to support the posts and wall panels. The entrance-side U-channels 30 do not connect, but rather leave a gap 35 adapted for placement of doors. A building perimeter 29 is defined by the four corners, or connecting points, 38 between every pair of connecting U-channels 30. As shown in FIG. 5*d*, each U-channel 30 has a pair of vertical arms 31 which extend upwardly from a horizontal floor 32.

Figure 2:
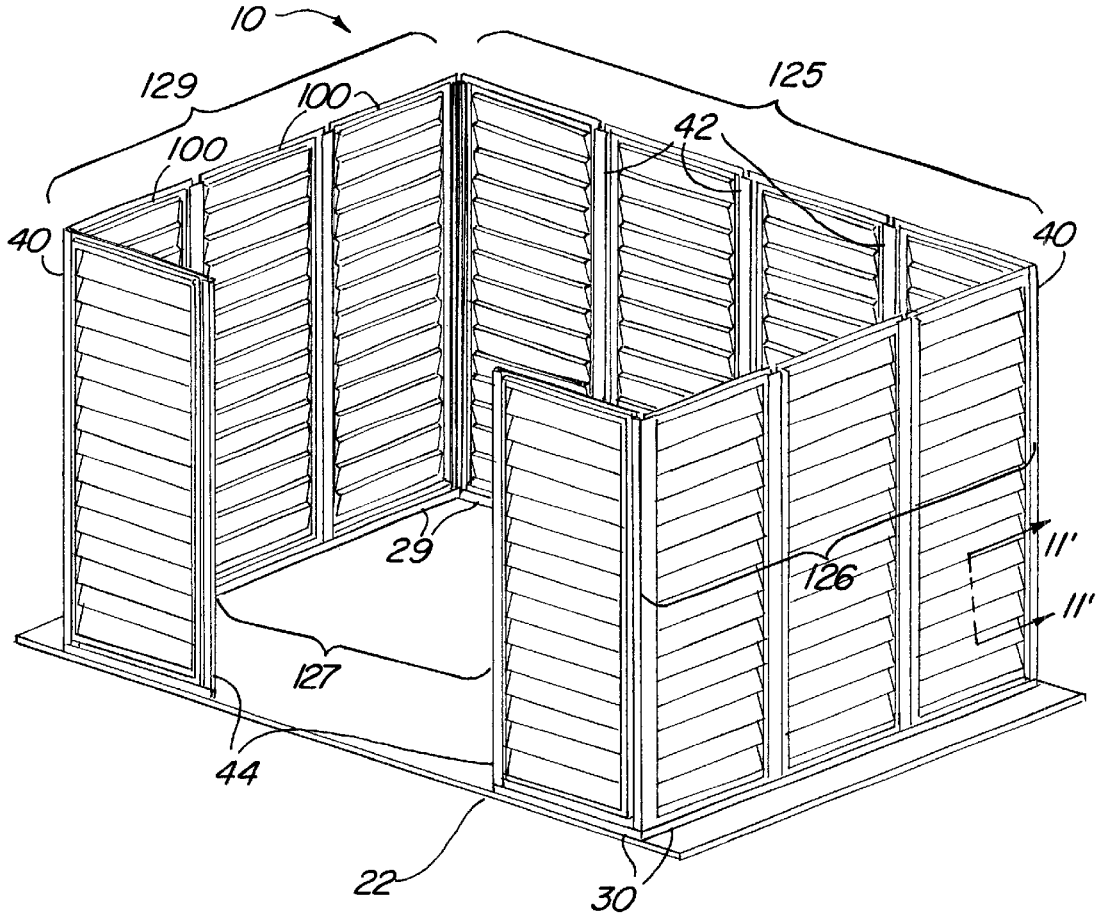
FIG. 2 is a perspective view of the storage shed in part.
Figure 3:
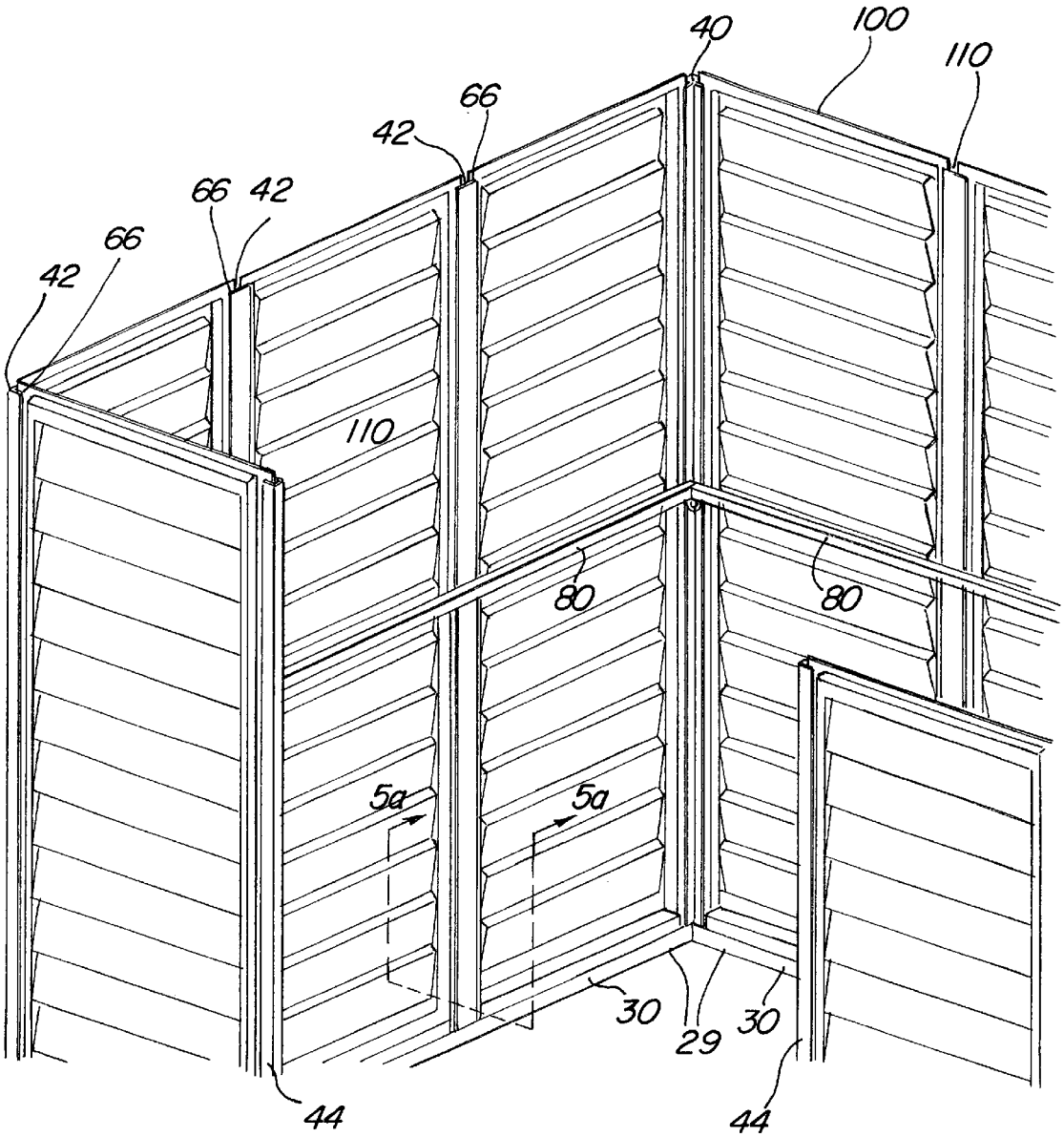
FIG. 3 is a close-up view showing an interior of a partially assembled storage shed.

FIGS. 2 and 3 are perspective views of the storage shed 10 in part. A plurality of posts, or columns, 40, 42, 44 are disposed along the building perimeter 29 as defined by the U-channels 30. The posts include corner posts 40, middle, or intermediary, posts 42, and door posts 44. Specifically, the bottom portions of the posts 40, 42, 44 are received in the U-channels 30. A plurality of corrugated wall panels 100 are disposed in between the posts 40, 42, 44. The bottom portions of the wall panels 100 are received in the U-channels 30. In FIG. 3, horizontal support bands 80 extend along the interior sides of the shed 10. The support bars 80 are coupled to the posts 40, 42.

Figure 4A:
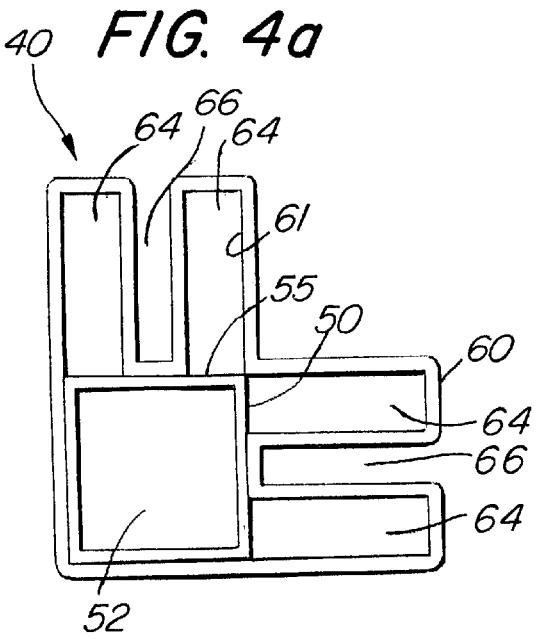
FIG. 4*a* is an end view of a corner post.
Figure 4B:
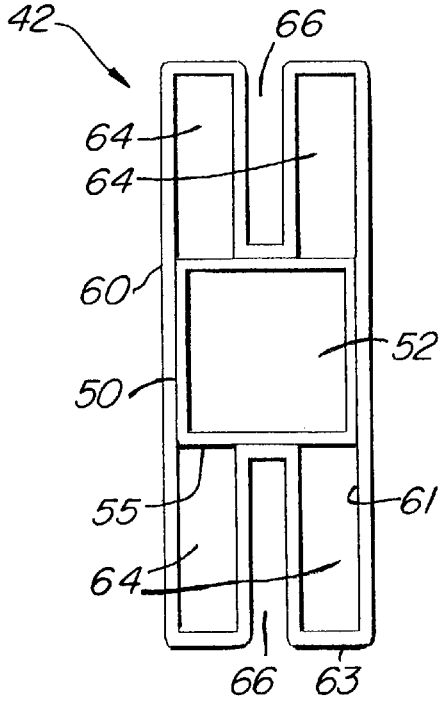
FIG. 4*b* is an end view of a middle post.
Figure 4C:
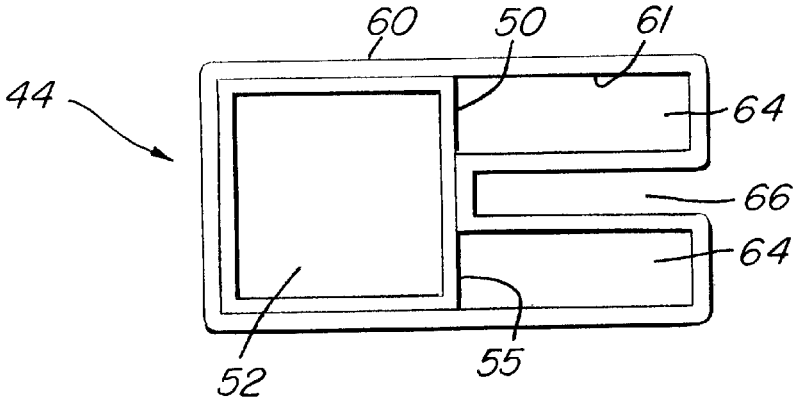
FIG. 4*c* is an end view of a door post.

FIGS. 4*a*, 4*b* and 4*c* are end views of the corner post 40, middle post 42, and door post 44, respectively. Each post 40, 42, 44 comprises a profile 60. In the preferred embodiment, the profile 60 is a prismatic structure having a substantially uniform cross-sectional shape throughout its length. The profile 60 comprises a rigid material, such as a thermoplastic material. In the preferred embodiment, the profile 60 comprises polyvinyl chloride which may be new, as in virgin PVC , used, as in scrap PVC, or a combination of both. A rigid, reinforcing bar 50 may be disposed within the profile 60. It is to be expressly understood, however, that the post may simply comprise the profile without a reinforcing bar. The bar 50 has a hollow core 52 and comprises a rigid material, including metal, wood and plastic. As shown in FIGS. 4*a*–4*c*, the profile 60 is formed around the bar 50 so as to create voids 64 between an inner, or interior, surface 61 of the profile 60 and an outer, or exterior, surface 55 of the bar 50. Longitudinal panel slots 66 are defined by an outer surface 63 of the profile 60. Since both the bar 50 and the profile 60 are prismatic, the voids 64 and slots 66 extend longitudinally throughout the length of the post 40, 42, 44. As will be described in greater detail later, the longitudinal panel slots 66 are sized to receive flat side portions of the corrugated wall panels. In the preferred embodiment, the corner posts 40 and middle posts 42 each comprise two longitudinal slots 66 while the door posts 44 each,comprise a single longitudinal slot 66. It will be appreciated that the structure of the posts results in a rigid design with minimal amount of material, thus saving costs.

Figure 5A:
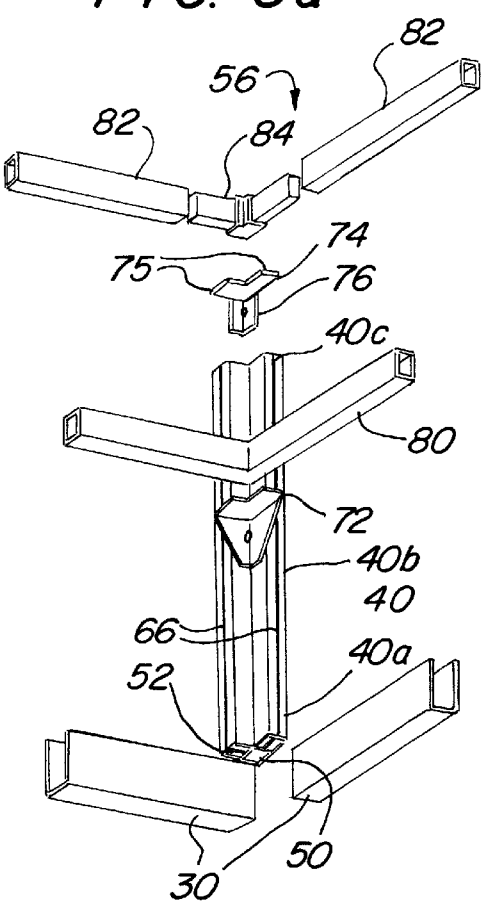
FIG. 5*a* is an exploded view of a corner post assembly.
Figure 5D:
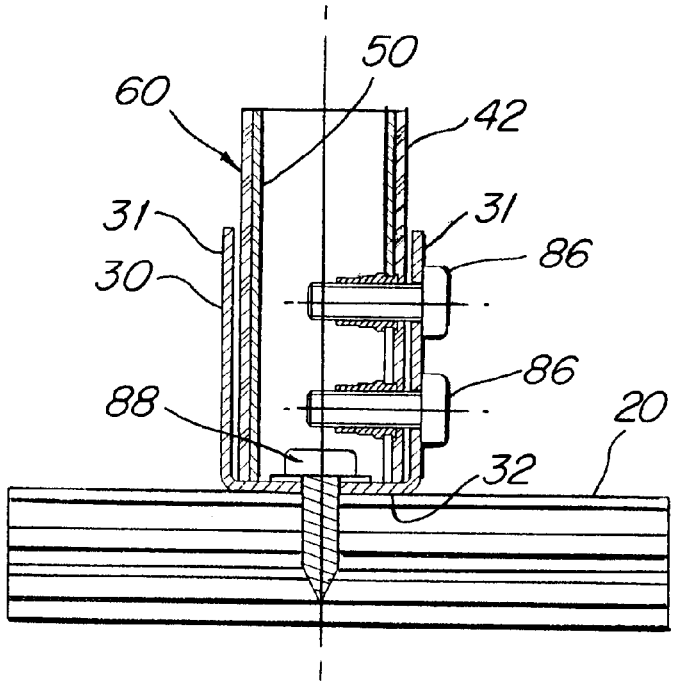
FIG. 5*d* is a cross-section view taken along lines 5*d*'—5*d*' of FIG. 3.

FIG. 5*a* is an exploded view of a corner post assembly 56. A bottom portion 40*a* of the corner post 40 is received in the U-channels 30. A center band fitting 72 is coupled to an interior mid-portion 40*b* of the corner post 40. The horizontal support bands 80 rest on top of the center band fitting 72. A corner fitting 74 is coupled to a top portion 40*c* of the corner post 40. The corner fitting 74 has a profile shape of an "L" defined by the arms 75 that conforms to the "L" profile of the corner post 40. The corner fitting 74 also comprises a downwardly extending member 76 that is inserted into the hollow core of the rigid bar 50, thus forming a tight fit. A corner portion of the roof frame rests on top of the corner fitting 74 and comprises square tubes 82 coupled to a corner joint 84.

Figure 5E:
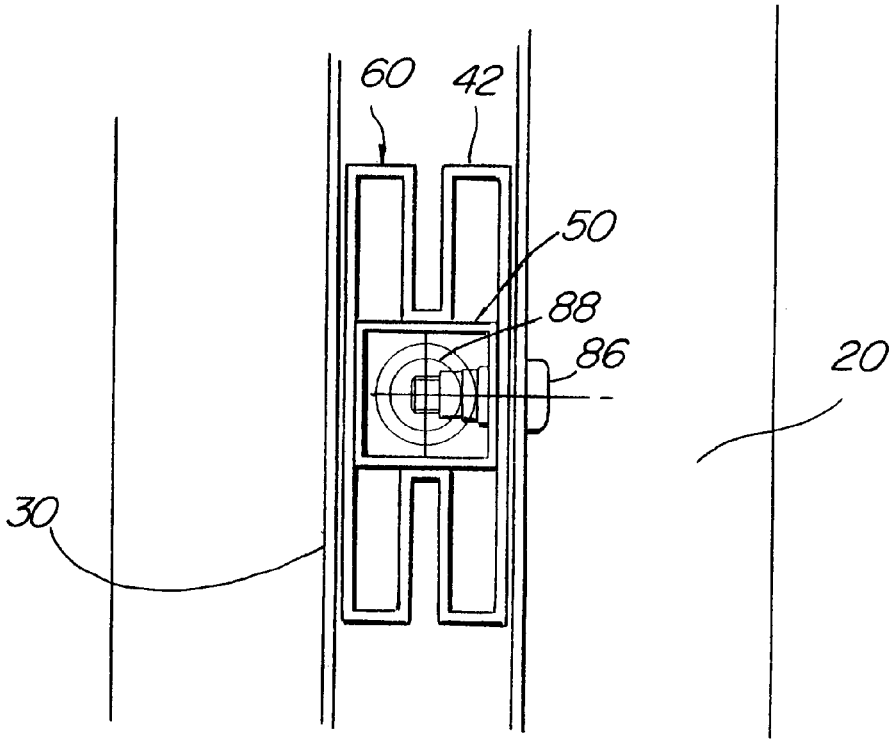
FIG. 5*e* is a top end view of a middle post assembly.

FIGS. 5*b* and 5*c* are exploded views of the middle post assembly 57 and the door column assembly 58, respectively. In FIGS. 5*b* and 5*c*, the posts 42, 44, respectively, are received in the U-channels 30. Roof fittings 78 are coupled to top portions of the posts 42, 44. A square tube 82 of the roof structure rests on top of the roof fittings 78. In FIGS. 5*a*–5*c*, the longitudinal slots 66 extend throughout the length of the of the posts 40, 42, 44. In FIGS. 5*d* and 5*e*, the posts 42 are secured to the U-channels 30 with screws 86 which penetrate horizontally through the U-channel 30, the plastic profile 60 and the rigid bar 50. The U-channel 30 is secured to the base 20 with a screw 88.

Figure 6:
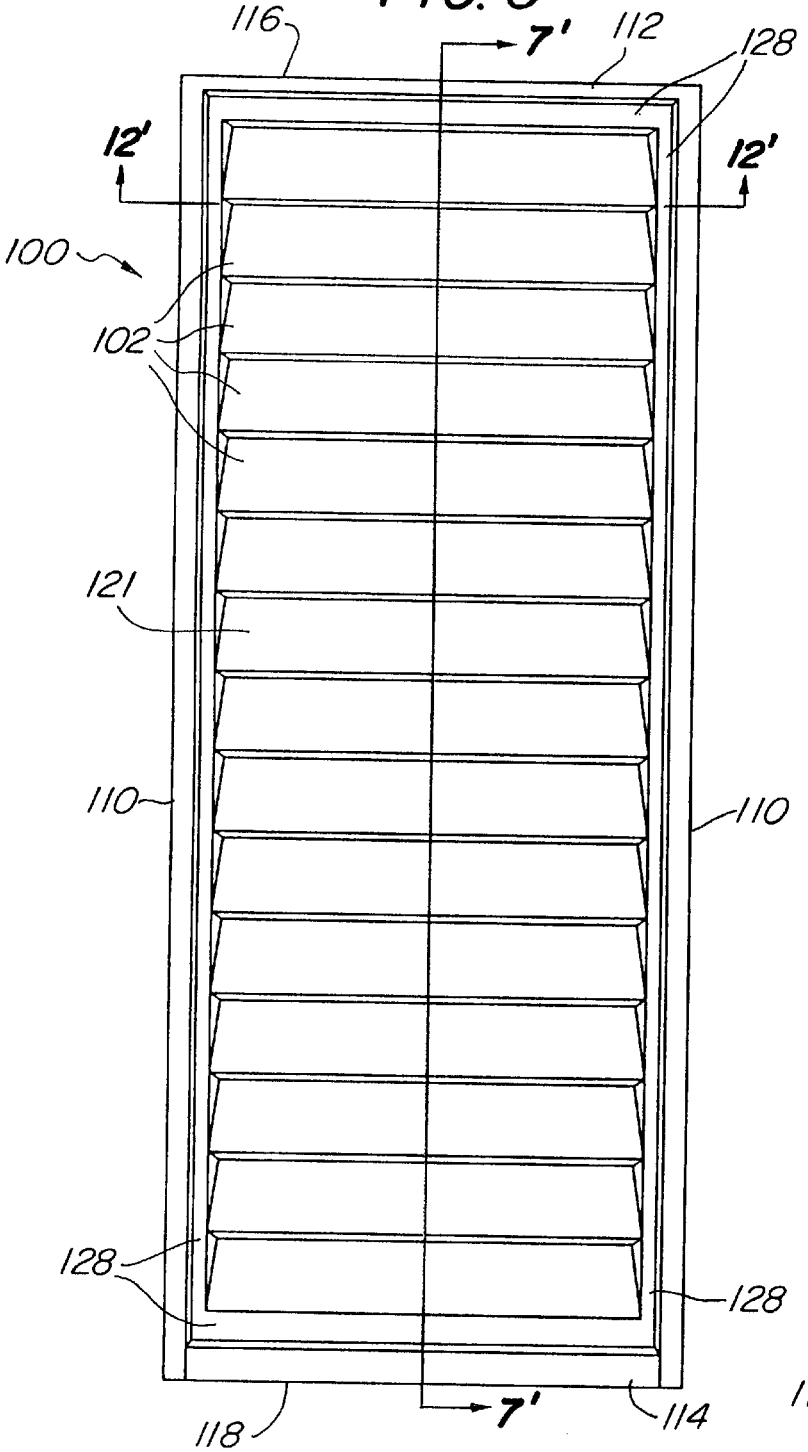
FIG. 6 is an exterior elevation view of a corrugated wall panel.
Figure 7:
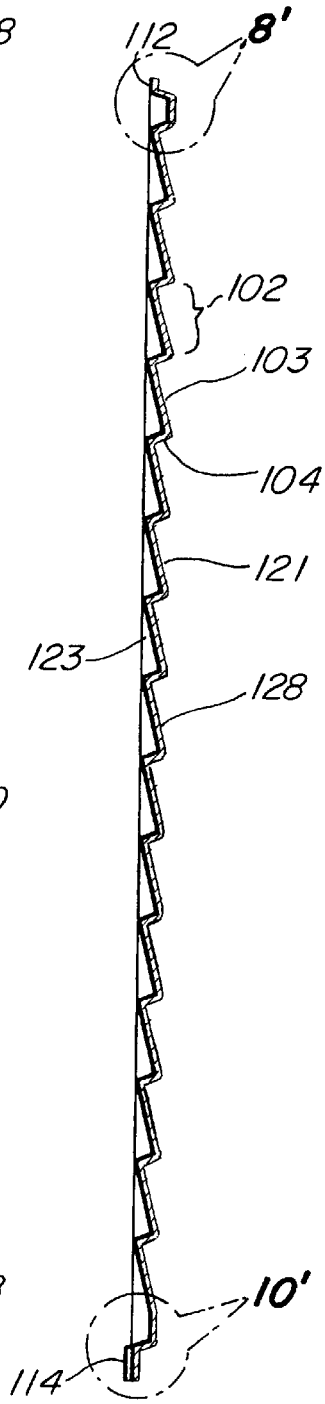
FIG. 7 is a longitudinal cross-section view of the corrugated wall panel taken along lines 7'—7' of FIG. 6.
Figure 10:
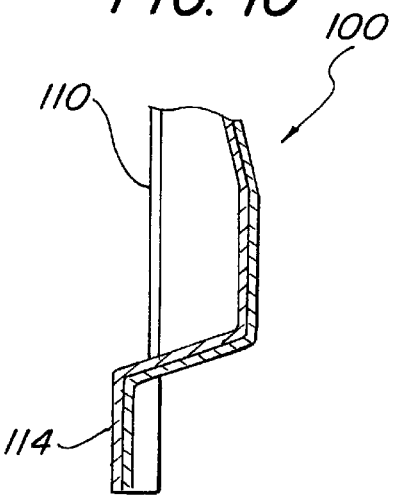
FIG. 10 is an enlarged view of the encircled area 10' of FIG. 7.

FIG. 6 is an outer, or exterior, elevation view of a corrugated wall panel 100. The corrugation comprises a plurality of parallel, latitudinal folds 102. The folds 102 provide additional strength and rigidity, thus enabling the wall panel 100 to better withstand outdoor conditions than non-corrugated wall panels. The panel 100 also comprises thin side flanges 110 which extend substantially along the length of the panel 100. The longitudinal flanges 110 are substantially flat so as to fit in a corresponding slot of an adjacent post. In FIGS. 6 and 7, the wall panel 100 also includes latitudinal flanges 112, 114 at a top 116 and bottom 118 of the panel 100, respectively. The panel 100 has an external surface 121 adapted to face outwardly, and an internal surface 123 adapted to face the interior of the shed. The wall panel 100 may include an aesthetic layer 128 disposed on an exterior side 121 and adapted to face outwardly when the panels 100 are assembled, as illustrated in greater detail in FIGS. 8 and 10. In the preferred embodiment, the aesthetic layer 128 comprises a virgin polyvinyl chloride laminate which is thermoformed onto the panel 100. Other types of aesthetic layers may be applied to give the external side 121 of the wall panel 100 an attractive appearance, including paint, a surface finish, and a host of other appearance enhancing materials or chemicals.

In FIG. 7, each fold 102 comprises a majority section, or ridge, 103 that extends gradually outward from top to bottom, and a minority section, or channel, 104 that slopes aggressively inward from top to bottom. Though the preferred embodiment is illustrated as such, the folds 102 of the wall panels 100 need not be parallel or latitudinal. For instance, the folds may extend longitudinally. Furthermore, the folds 102 may be designed in a non-parallel arrangement, be it longitudinal, latitudinal, a combination of both, or neither. In the preferred embodiment, the corrugated wall panels 100 comprise polyvinyl chloride. More specifically, the wall panels 100 are primarily made of regrind polyvinyl chloride. A rectangular border 128 protrudes outwardly and surrounds the folds 102.

Figure 8:
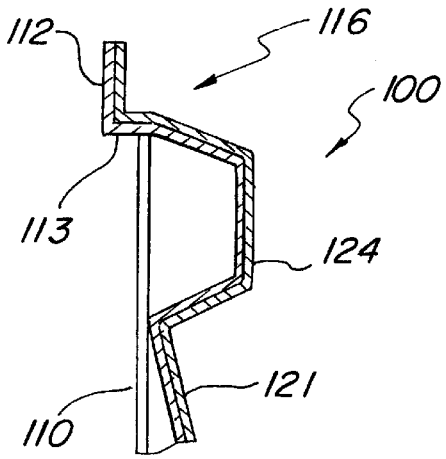
FIG. 8 is an enlarged view of the encircled area 8' of FIG. 7.
Figure 9:
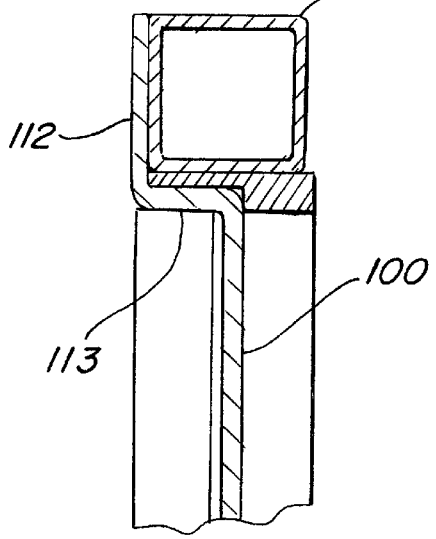
FIG. 9 is a cross-sectional view of the a top portion of the wall panel in configuration with the middle post assembly of FIG. 5*b;*
Figure 11:
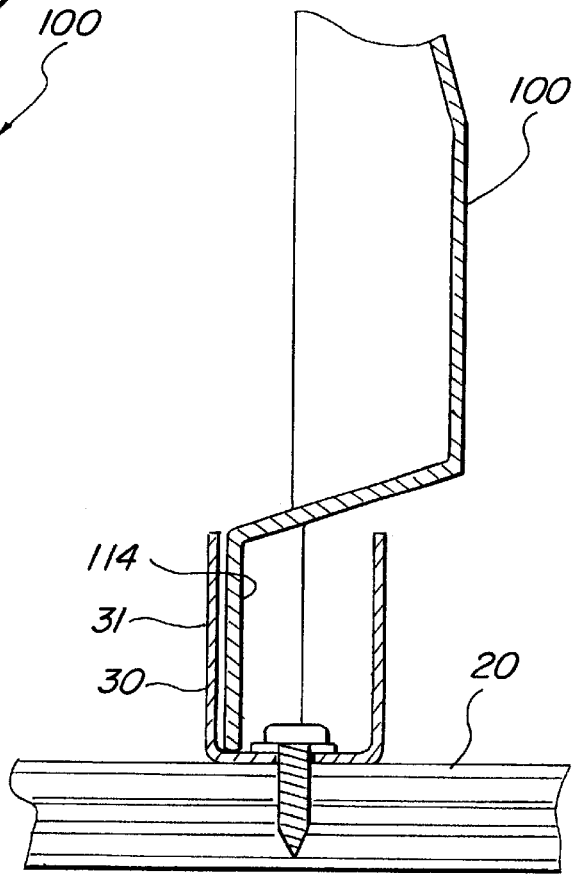
FIG. 11 is a cross-sectional view taken along lines 11'—11' of FIG. 2 showing the bottom portion of the wall panel received in a U-channel.

FIGS. 8 is an enlarged, close-up view of the encircled area 8' of FIG. 7 illustrating the top portion 116 of the panel 100. In FIG. 8, the top latitudinal flange 112 is disposed inwardly, or rearwardly, such that the latitudinal flange 112 lies on a plane that is different from the plane upon which the side flanges 110 are disposed. The purpose and advantage of this indented latitudinal flange. 112 is illustrated in FIG. 9. The latitudinal flange 112 along with its connecting support member 113 forms an L-structure which receives a portion of the square tube 82 of the roof structure, thus providing a secure fit between the roof structure and the wall panels 100, as shown in FIG. 9. Similarly, in FIG. 10, the bottom latitudinal flange 114 is also disposed inwardly, such that it lies on a different plane than that upon which the side flanges 110 are disposed. The advantage of this indented bottom latitudinal flange 114 is illustrated in FIG. 11. By disposing the bottom latitudinal flange 114 inwardly, the bottom latitudinal flange 114 can be placed against one of the vertical arms 31 of the U-channel 30, thus providing a secure fit between the panel 100 and the base 20. Thus, it can be appreciated that the wall panels 100 provide for secure fits with the roof structure and the base, thus leading to an overall shed that is tightly assembled and, consequently, strong in structure.

Figure 12:
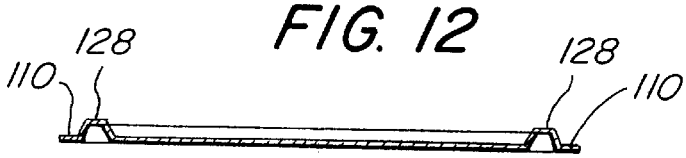
FIG. 12 is a latitudinal cross-section view of the corrugated wall panel taken along lines 12'—' of FIG. 6.

FIG. 12 is a latitudinal cross-section view of the corrugated wall panel 100 taken along lines 12'—12' of FIG. 6. Each side flange 110 is not only flat, but substantially thin so as to fit within the longitudinal slots 66 of the posts 40, 42, 44 as shown in FIG. 3. FIG. 12 also illustrates the outwardly protruding border 128 which surrounds the folds.

As shown in FIGS. 2 and 3, each wall panel 100 is disposed between two adjacent posts 40, 42, 44 with the side flanges 110 of the panels 100 fitting inside the longitudinal slots 66 of the posts 40, 42, 44. The panels 100 and the posts 40, 42, 44 are erected along the building perimeter 29, as defined by the U-channels 30, to form three walls 124, 125, 126 while leaving an opening 127 on the entrance side 22 of the shed 10 for the placement of doors.

Figure 13:
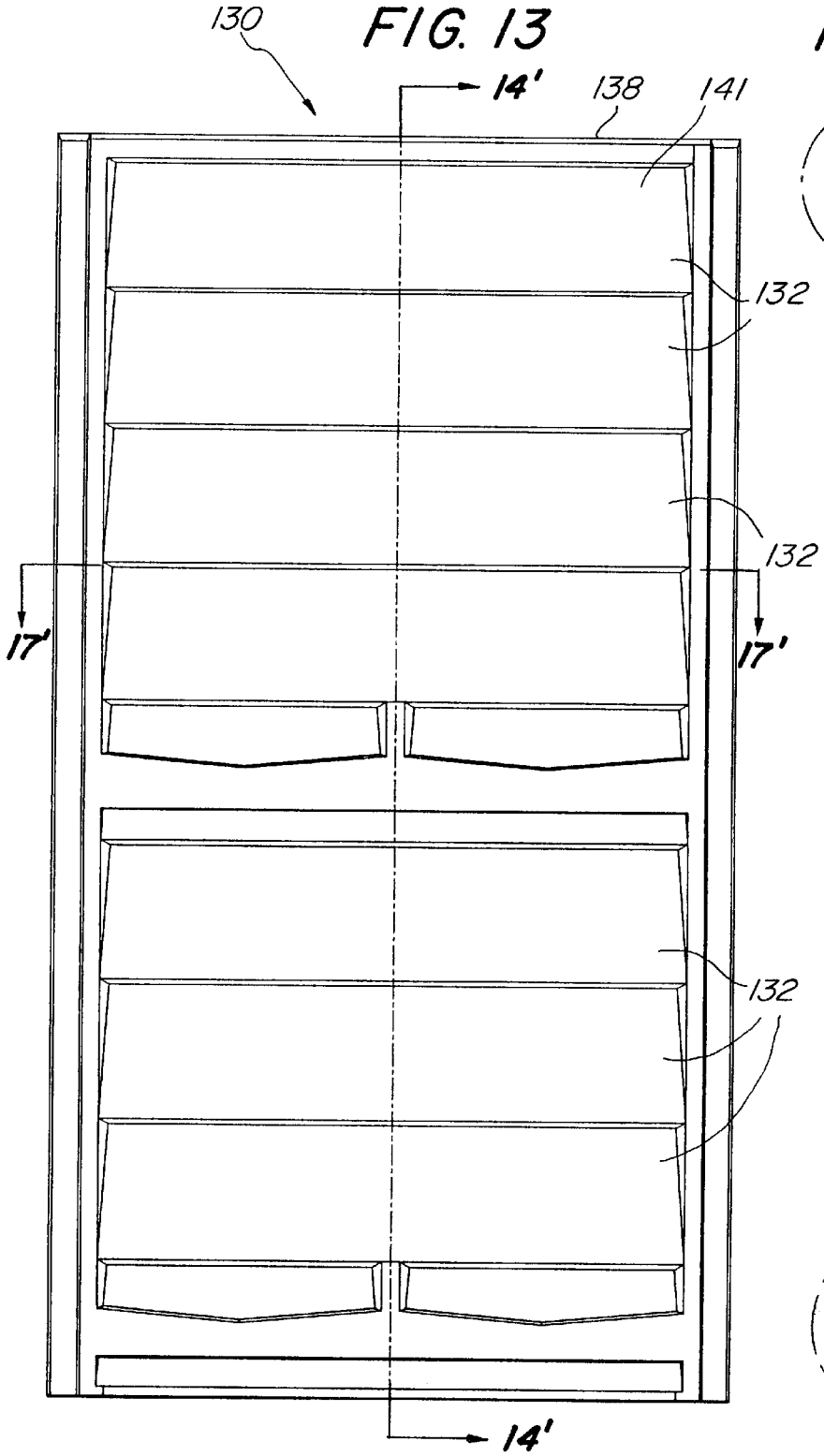
FIG. 13 is an exterior elevation view of a corrugated roof panel.
Figure 14:
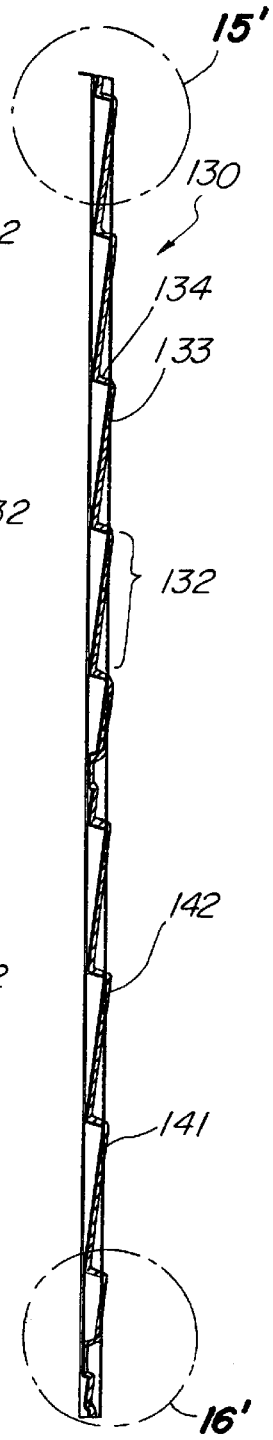
FIG. 14 is a longitudinal cross-section view of the corrugated wall panel taken along lines 14'—14' of FIG. 13.

FIG. 13 is an exterior elevation view of a corrugated roof panel 130. The corrugation comprises a plurality of latitudinal folds 132. Similar to the corrugated wall panels, the folds 132 provide additional rigidity, enabling the roof panel 130 to better withstand outdoor conditions than non-corrugated roof panels. FIG. 14 is a longitudinal cross-section view of the corrugated roof panel according to lines 14'—14' of FIG. 13. Thus each fold 132 comprises a majority section, or ridge, 133 sloped in one direction and a minority section, channel, 134 sloped in an opposite direction. The folds 132 of the roof panels 130 need not be parallel or latitudinal. For instance, the folds may run along the length of the roof panel 130. Furthermore, the folds 132 may be designed in a non-parallel arrangement, be it longitudinal, latitudinal, both, or neither. In the preferred embodiment, the corrugated wall panels 132 comprise polyvinyl chloride. An aesthetic layer 141 may be disposed on an external side 142 of the roof panel 130 and adapted to face upwardly when the roof panel 130 is assembled. In the preferred embodiment, the aesthetic layer 141 comprises a virgin polyvinyl chloride laminate which is thermoformed onto the roof panel 130. Other types of aesthetic layers may be applied to give the external surface 141 of the roof panel 130 an attractive appearance, including paint, a surface finish, and a host of other appearance enhancing materials or chemicals.

Figure 15:
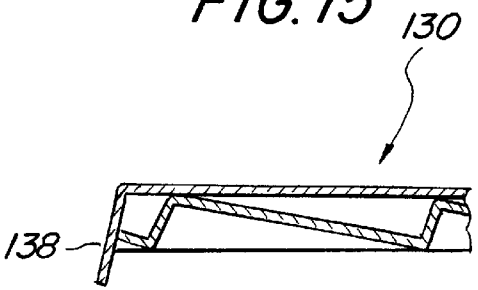
FIG. 15 is an enlarged view of the encircled area 15' of FIG. 14.
Figure 16:
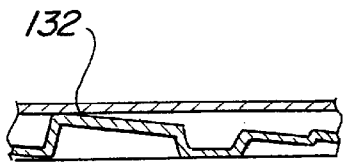
FIG. 16 is an enlarged view of the encircled area of 16' of FIG. 14.

FIG. 15 is an enlarged, close-up view of the encircled area 15' of FIG. 14. The roof panel 130 includes a latitudinal flange 138 which protrudes inwardly. FIG. 16 is a close-up view of the encircled area 16' of FIG. 14 illustrating the folds 132.

Figure 17:
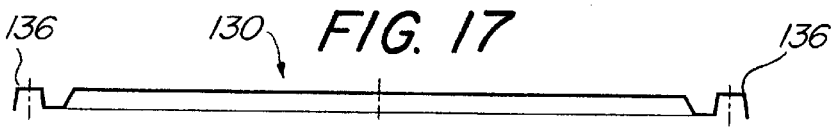
FIG. 17 is a latitudinal cross-section view of the corrugated wall panel taken along lines 17'—17' FIG. 13.
Figure 18:
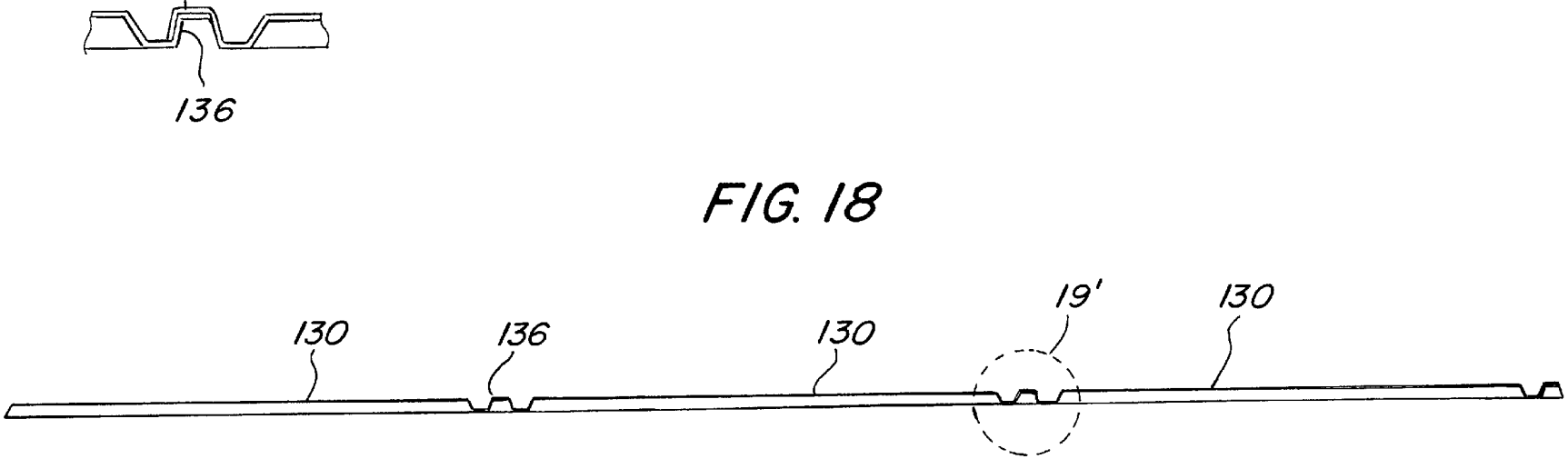
FIG. 18 is an end plan view of the roof panels in an operative configuration, illustrating their overlapping relationship.
Figure 19:
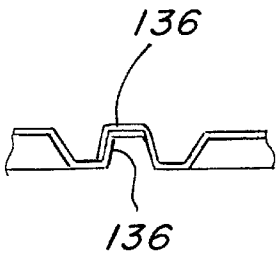
FIG. 19 is a close-up view of the encircled area 19' in FIG. 18.

FIG. 17 is a latitudinal cross-section view of the corrugated roof panel 130 taken along lines 17'—17' of FIG. 13. Each roof panel 130 has side portions 136 configured, or adapted, to be in a overlapping relationship with a side portion 136 of another roof panel 130 as shown in FIGS. 18 and 19. FIG. 18 is an end view of the roof panels 130 in an operative configuration, illustrating the overlapping relationship of the side portions 136. FIG. 19 is an enlarged, close-up view of the encircled area 19' of FIG. 18. FIG. 19 shows the overlapping side portions 136 of adjacent roof panels 130. The overlapping relationship of the side portions 136 provides a secure fit for the roof panels 130 as they are disposed on the roof frame. Furthermore, this overlapping serves to better insulate the storage shed 10 from outdoor elements, including both solid and liquid matter.

Figure 20:
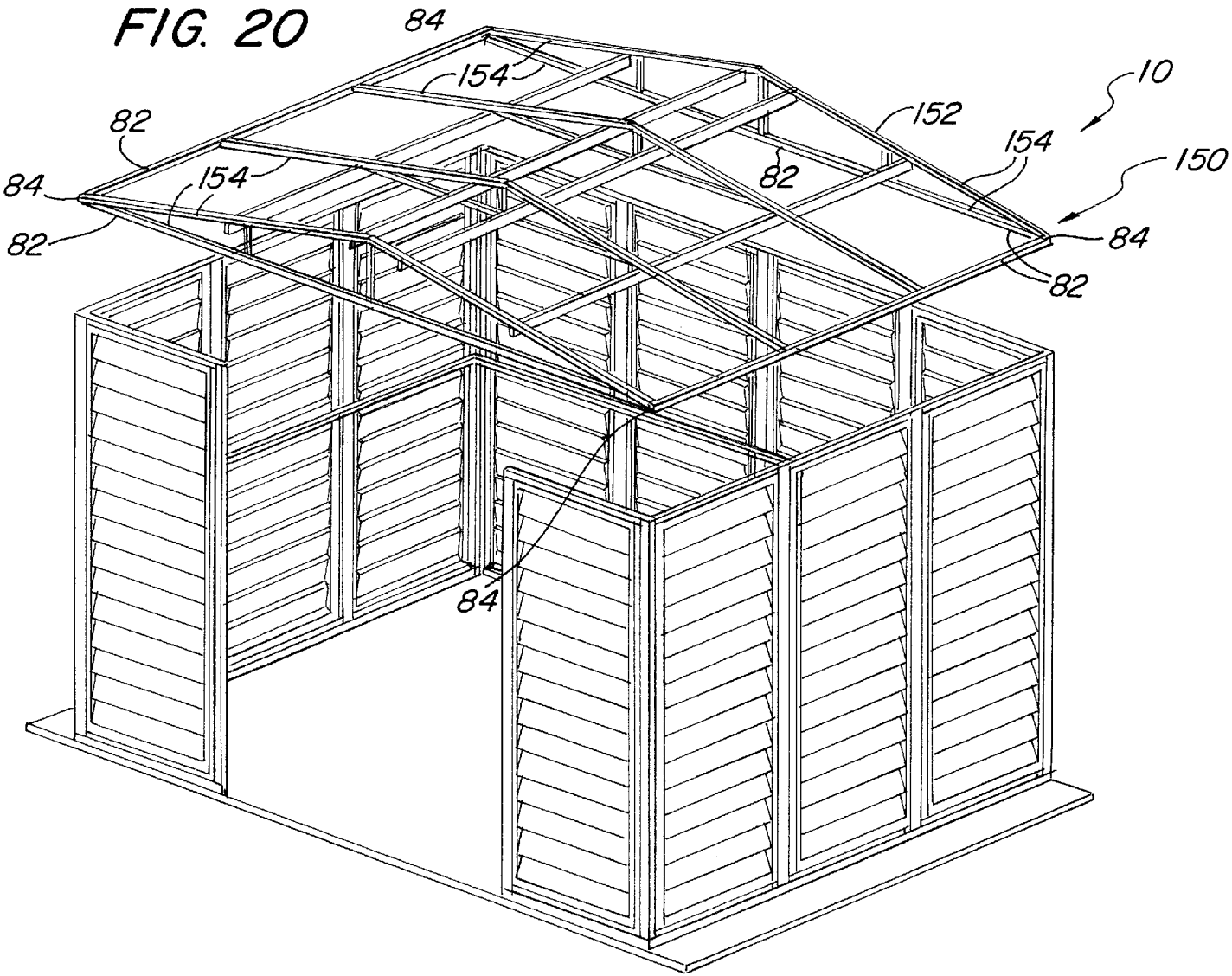
FIG. 20 is a perspective view of the storage shed in part, with remaining elements omitted to provide a clear view of the illustrated elements.

FIG. 20 is an exploded perspective view of the storage shed 10 in part. The roof frame 150 may comprise a limitless variety of structures so as to support roof panels (not shown). In the preferred embodiment, the roof frame 150 comprises a plurality of bars 152 which are interconnected by a plurality of plastic joints 154 and corner joints 84. The roof frame 150 further comprises a plurality of perimeter square tubes.82 which form the perimeter of the frame 150 and sit on top wall panels 100 and posts 40, 42, 44, as shown in FIGS. 5*a*, 5*b*, 5*c* and 9.

Figure 21:
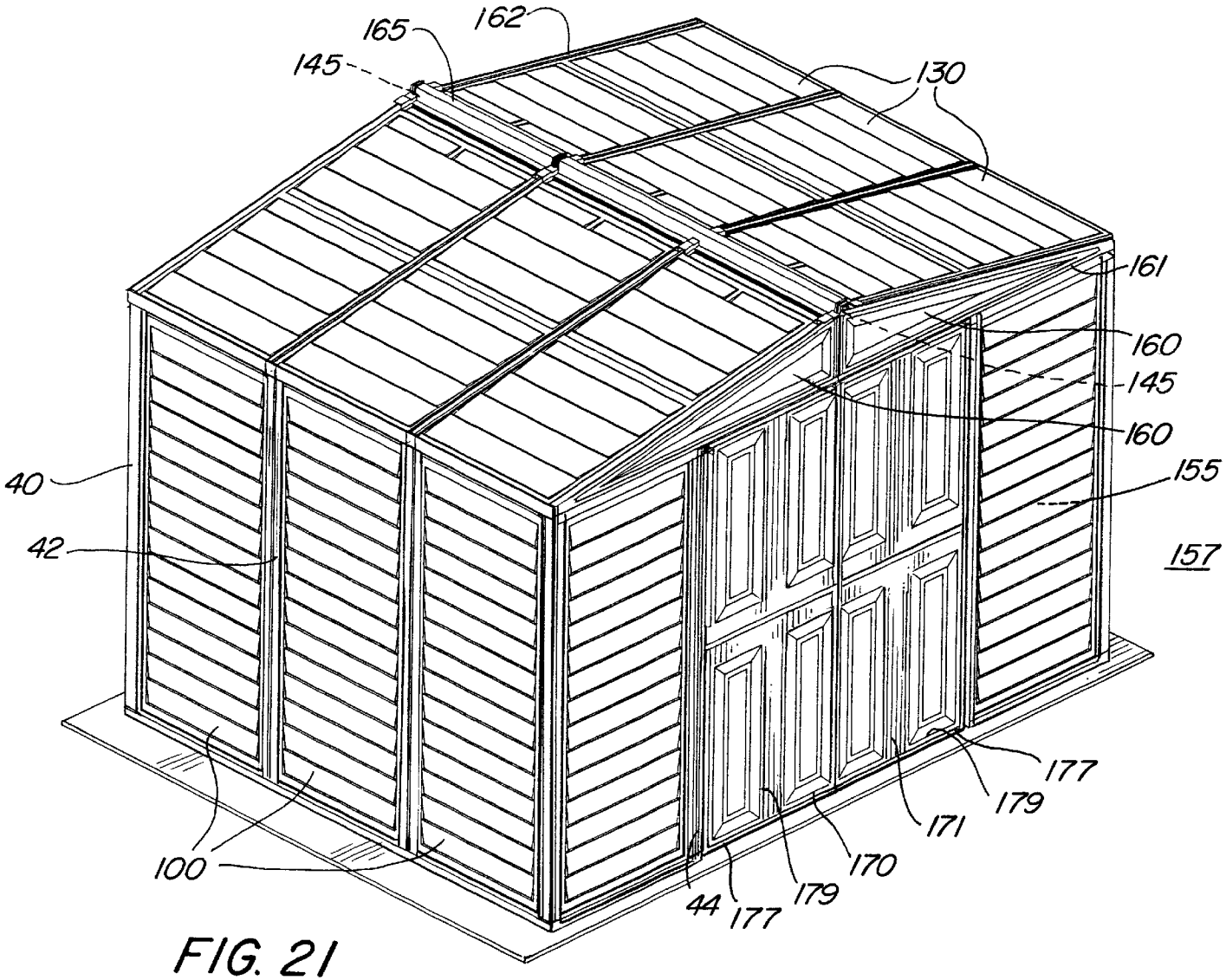
FIG. 21 is a perspective view of the storage shed.

FIG. 21 is perspective view of the storage shed 10. The roof frame (covered) is disposed on top of the vertical posts 40, 42, 44 and the corrugated wall panels 100. Pairs of facia boards 160 are disposed on an entrance side 161 and a back side 162 of the roof frame. In the preferred embodiment, the facia boards 160 comprise polyvinyl chloride. The roof panels 130 are disposed on top of the roof frame (covered) and coupled to the roof frame by pins (not shown). Any type of mechanism, however, may be used to secure the roof panels 130 to the roof frame. An interior 155 is defined within the storage shed 10 while an exterior 157 is defined outside the storage shed 10. The storage shed 10 further comprises ridge panels 165 disposed along the center line 145 of the roof. Each ridge panel 165 covers, or overlaps, a portion of a roof panel 130. In the preferred embodiment, the ridge panels 165 comprise polyvinyl chloride. Both the corrugated wall panels 100 and the corrugated roof panels 130 may be considered building panels, although building panels may include more than just wall or roof panels.

The storage shed 10 further comprises a pair of doors 170, 171 which may be coupled to the entrance-side vertical posts 44 by hinges 173. It is to be understood that a variety of entrance mechanisms may be applied to this invention. For instance, sliding doors (not shown) may be used. In the preferred embodiment, the doors 170, 171 are made of polyvinyl chloride. Furthermore, each door 170, 171 has a metallic border 177 on an exterior side 179.

Therefore, in the preferred embodiment, the posts 40, 42, 44, corrugated wall panels 100, facia boards 160, corrugated roof panels 130, ridge panels 160 and doors 170, 171 are all made of polyvinyl chloride. More specifically, they all be made from regrind, or scrap, polyvinyl chloride. Each of these structures may include an aesthetic layer disposed on an external surface which would be visible from outside the shed. This gives the shed an attractive overall appearance from the outside and conceals the less attractive regrind polyvinyl chloride from which the shed is primarily composed. Since the composition of the above structures may primarily comprise scrap polyvinyl chloride, it will be appreciated that such an attractive overall appearance may be accomplished cost effectively by using a minimal amount of virgin polyvinyl chloride for the aesthetic layers. Furthermore, making various panels and structures out of scrap polyvinyl chloride is an innovative use of material which would otherwise be discarded.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. The claims are thus to be understood to include what is specifically illustrated and described above, what is conceptionally equivalent, what can be obviously substituted and also what essentially incorporates the essential idea of the invention.

What is claimed is:

1. A shed comprising:

(a plurality of posts, each comprising at least one longitudinal slot;

corrugated wall panels disposed in between the posts, each corrugated wall panel comprising a plurality of folds extending in a first direction and at least one longitudinal, flat side flange extending in a second direction perpendicular to the first direction, the flat side flange protruding laterally from the plurality of folds so as to slidingly fit within the longitudinal slot of an adjacent post; and corrugated roof panels.

2. The shed of claim 1 wherein each post comprises a prismatic profile.

3. The shed of claim 2 wherein each post comprises a bar disposed within the profile.

4. The shed of claim 3 wherein the longitudinal slot is defined in the profile and a void is defined between an external surface of the bar and an internal surface of the profile.

5. The shed of claim 3 wherein the profile comprises a thermoplastic material.

6. The shed of claim 1 wherein the corrugated wall panels comprise a thermoplastic material.

7. The shed of claim 6 wherein the corrugated wall panels comprise polyvinyl chloride.

8. The shed of claim 1 wherein each corrugated wall panel comprises an aesthetic layer disposed on an exterior side.

9. The shed of claim 1 wherein the folds of the corrugated wall panels are latitudinal and parallel.

10. The shed of claim 1 wherein each corrugated wall panel comprises an indented top flange.

11. The shed of claim 10 wherein each corrugated wall panel comprises an indented bottom flange.

12. The shed of claim 1 wherein side portions of adjacent corrugated roof panels overlap.

13. The shed of claim 1 further comprising at least one door.

14. The shed of claim 1 further comprising a roof frame having a plurality of tubes wherein the corrugated roof panels are disposed on the roof frame.

15. The shed of claim 1 further comprising a base, wherein the posts are disposed along a periphery of the base.

16. The shed of claim 15 further comprising a guide disposed on the base for supporting the posts and corrugated wall panels.

17. The shed of claim 16 wherein the guide comprises a U-channel.

18. A storage shed building panel having a height, comprising:

a plurality of parallel horizontally extending folds;

an outwardly protruding border surrounding the plurality of parallel horizontally extending folds; inwardly indented top flange; inwardly indented bottom flange; and a vertical, flat side flange protruding laterally from the plurality of folds and extending substantially along the height.

19. The panel of claim 18 wherein the aesthetic layer comprises a virgin polyvinyl chloride laminate.

20. The panel of claim 18 wherein the plurality of parallel latitudinal folds comprises ridges and channels extending horizontally.

21. The panel of claim 18 wherein the longitudinal side flange is shaped to overlap with a longitudinal side flange of another panel.

22. A storage shed post comprising:

a prismatic profile;

a longitudinal slot formed in the profile and adapted to loosely and laterally receive a flat side portion of a wall panel; and a hollow bar disposed within the prismatic profile, wherein the prismatic profile is shaped around the bar so as to form a void between an external surface of the bar and an internal surface of the profile and wherein the external surface of the hollow bar comprises flat portions which abut flat portions of the internal surface of the profile.

23. The post of claim 22 wherein the profile comprises a thermoplastic material.

24. The post of claim 23 wherein the thermoplastic material comprises polyvinyl chloride.

25. The post of claim 22 wherein the longitudinal slot extends inwardly towards the bar such that the internal surface of the profile contacts the external surface of the bar.

26. A method for building a shed, the method comprising:

providing to the base;

erecting posts with longitudinal slots onto base;

disposing between the posts corrugated wall panels with flat longitudinal side flanges and latitudinal folds;

laterally fitting the flat longitudinal side flanges of the corrugated wall panels into the longitudinal slots of adjacent posts;

mounting a roof frame above the vertical posts and the corrugated wall panels; and disposing corrugated roof panels on the roof frame.

27. The method of claim 26 wherein disposing corrugated roof panels on the roof frame further comprises overlapping side portions of adjacent corrugated roof panels.

28. The method of claim 26 further comprising disposing a door along an entrance side of the shed.

29. The method of claim 26 further comprising making the corrugated wall panels and the corrugated roof panels out of recycled polyvinyl chloride.

30. The method of claim 26 further comprising disposing an aesthetic laminate layer on an external side of the corrugated roof panel.

31. The method of claim 26 further comprising disposing an aesthetic laminate layer on an external side of the corrugated wall panel.

32. The method in claim 26 further comprising disposing a U-shaped channel along a perimeter of the base for supporting the posts and corrugated wall panels.

33. The shed of claim 1, wherein the longitudinal side flange extends across the plurality of folds.

34. The panel of claim 18, further comprising polyvinyl chloride.

35. The panel of claim 18, further comprising an aesthetic layer.

* * * * *